US010449785B2

(12) United States Patent
Sakai

(10) Patent No.: US 10,449,785 B2
(45) Date of Patent: Oct. 22, 2019

(54) TRAY, PRINTING APPARATUS, AND INFORMATION PROCESSING METHOD

(71) Applicant: CANON KABUSHIKI KAISHA, Tokyo (JP)

(72) Inventor: Hiroyuki Sakai, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/136,598

(22) Filed: Sep. 20, 2018

(65) Prior Publication Data

US 2019/0016158 A1 Jan. 17, 2019

Related U.S. Application Data

(62) Division of application No. 15/603,490, filed on May 24, 2017, now Pat. No. 10,112,417.

(30) Foreign Application Priority Data

May 31, 2016 (JP) ..... 2016-108056

(51) Int. Cl.

| | |
|---|---|
| ***B41J 11/00*** | (2006.01) |
| ***B41J 11/58*** | (2006.01) |
| ***B41J 11/06*** | (2006.01) |

(52) U.S. Cl.
CPC ..... *B41J 11/0065* (2013.01); *B41J 11/06* (2013.01); *B41J 11/58* (2013.01)

(58) Field of Classification Search
CPC ..... B41J 11/0065
See application file for complete search history.

(56) References Cited

U.S. PATENT DOCUMENTS

| | | | | |
|---|---|---|---|---|
| 2004/0017462 | A1* | 1/2004 | Takahashi | B41J 3/4071 347/104 |
| 2005/0093953 | A1* | 5/2005 | Miyake | B41J 2/01 347/104 |
| 2006/0080687 | A1 | 4/2006 | Miyashita | |
| 2006/0243644 | A1* | 11/2006 | Takeshita | B41J 3/4071 209/539 |

FOREIGN PATENT DOCUMENTS

| | | | |
|---|---|---|---|
| JP | 2004-230655 | A | 8/2004 |
| JP | 2004-338338 | A | 12/2004 |
| JP | 2005-104112 | A | 4/2005 |
| JP | 2008-183842 | A | 8/2008 |

* cited by examiner

*Primary Examiner* — Jason S Uhlenhake
(74) *Attorney, Agent, or Firm* — Venable LLP

(57) ABSTRACT

A tray includes a holding portion configured to hold a print medium in a predetermined holding area and an ink absorption portion positioned adjacent to the holding area.

14 Claims, 6 Drawing Sheets

TRAY, PRINTING APPARATUS, AND INFORMATION PROCESSING METHOD

This application is a divisional of U.S. patent application Ser. No. 15/603,490, filed May 24, 2017, which claims the benefit of Japanese Patent Application No. 2016-108056 filed May 31, 2016, which are hereby incorporated by reference herein in their entirety.

BACKGROUND OF THE INVENTION

Field of the Invention

The present invention relates to a tray that holds a print medium on which an image is printed with ink in a marginless manner, and a printing apparatus and an information processing method using the tray.

Description of the Related Art

Japanese Patent Laid-Open No. 2004-338338 describes an ink jet printing apparatus including a tray dedicated to printable discs in order to apply ink to the printable discs to print an image. Examples of the printable discs include CDs (Compact Discs) and DVDs (Digital Versatile Discs).

Japanese Patent Laid-Open No. 2004-338338 describes no configuration configured to print an image on a print medium such as printable discs in a marginless manner. Margin-less printing is a method of printing an image on a print medium so as to avoid forming a margin at the edge of at least a part of the print medium. Ink is applied even to an area located outside the print medium.

In a case where marginless printing is performed using the printing apparatus described in Japanese Patent Laid-Open No. 2004-338338, ink adhering to the outside of the print medium may adhere to the dedicated tray for printable discs, and the adhering ink may be attached to a user's hand. Thus, the printing apparatus described in Japanese Patent Laid-Open No. 2004-338338 fails to perform marginless printing. In general, the dedicated tray for printable discs is formed of a hard material such as plastics and is likely to repel ink. In a case where marginless printing is performed using such a tray, the ink on the tray is likely to adhere to the user's hand.

SUMMARY OF THE INVENTION

The present invention is to provide a tray, a printing apparatus, and an information processing method that are suitable for marginless printing performed by applying ink to a print medium held on the tray.

In the first aspect of the present invention, there is provided a tray conveyed to a printing apparatus while holding a print medium such that the print medium is printed in a marginless manner with ink applied by a print unit of the printing apparatus, the tray comprising:

a holding portion configured to hold the print medium in a predetermined holding area; and an ink absorption portion positioned adjacent to the holding area.

In the second aspect of the present invention, there is provided a printing apparatus comprising:

a tray configured to be conveyed to the printing apparatus while holding a print medium, the tray including a holding portion configured to hold the print medium in a predetermined holding area and an ink absorption portion positioned adjacent to the holding area; and a printing unit configured to print an image on the print medium held on the tray with ink in a marginless manner.

In the third aspect of the present invention, there is provided an information processing method comprising:

a step of reading, from an information recording portion of a tray, information on a number of marginless printing operations enabled to be performed using one tray and information on a number of the marginless printing operations performed using the one tray, the tray including a holding portion configured to hold, in a holding area, a print medium on which an image is printed in a marginless manner, an ink absorption portion positioned adjacent to the holding area, and the information recording portion in which the information is enable to be recorded, a calculation step of calculating information on a remaining number of executable marginless printing operations by subtracting the number of the marginless printing operations performed from the number of the marginless printing operations enabled to be performed; and a display step of displaying at least one of the information recorded in the information recording portion and the remaining number of the executable marginless printing operations.

In the invention, the absorption portion absorbs ink attached to the tray during marginless printing to minimize the adverse effect of ink adhering to the tray.

Further features of the present invention will become apparent from the following description of exemplary embodiments with reference to the attached drawings.

DESCRIPTION OF THE EMBODIMENTS

First, before description of the embodiments of the present invention, basic configurations of an information processing apparatus and a printing apparatus will be described.

(Basic Configuration)

<Hardware Configuration of the Information Processing Apparatus>

Figure 1:
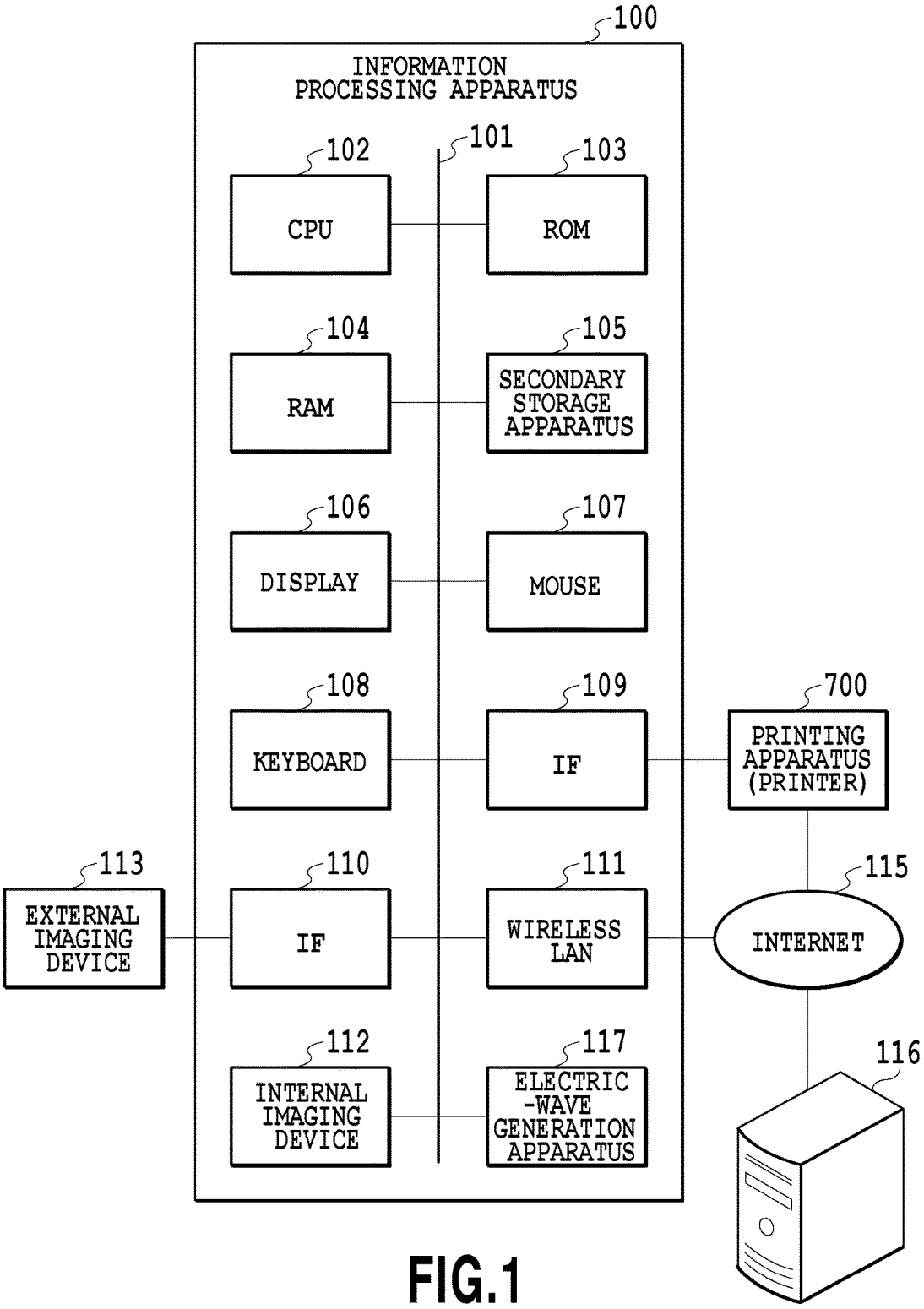
FIG. 1 is a diagram illustrating a basic configuration of an information processing apparatus.

FIG. 1 is a block diagram illustrating a configuration example of hardware of an information processing apparatus 100. A control bus/data bus 101 connects components of the information processing apparatus 100 to a CPU 102 (Central Processing Unit). The CPU 102 executes an information processing method described below in accordance with a program. A ROM 103 stores the program executed by the CPU 102. A RAM 104 provides a memory that temporarily stores various pieces of information in a case where the CPU 102 executes the program. A secondary storage apparatus 105 such as hard disk is a storage medium configured to store a database containing image files and results of image analysis. A display (display portion) 106 is an apparatus configured to provide results of processing to a user. The information processing apparatus 100 is also provided with a mouse 107 via which the user inputs instructions for processing and the like and a keyboard 108 via which characters and the like are input. Instead of the mouse 107 and the keyboard 108, a touch panel function may be provided in the display 106 so that instructions for processing, characters, and the like can be input by operating the touch panel. An internal imaging device 112 may also be provided. Images taken by the internal imaging device 112 are subjected to predetermined image processing and then stored in the secondary storage apparatus 105.

Image data may be loaded through an external imaging device 113 connected to the information processing apparatus 100 via an interface (IF) 110. A wireless LAN (Local Area Network) 111 may further be provided and connected to the internet 115. Image data may be acquired from an external server 116 connected to the internet.

A printing apparatus (printer) 700 configured to print an image is connected to the information processing apparatus 100 via an IF 109. A printing apparatus 700 is connected onto the internet to enable input and output of print data via the wireless LAN 111. An electric-wave generating apparatus 117 generates magnetic fields based on power transmitted from the information processing apparatus 100 to generate electric waves for data communication and the like. The electric-wave generating apparatus 117 has, for example, a near-field radio communication function such as NFC. Apparatuses incorporating the information processing apparatus 100 are mobile computer terminals, for example, smartphones and tablet computers. Apparatuses incorporating the information processing apparatus 100 include apparatuses incorporating an electric-wave generating apparatus, such as digital cameras, video cameras, and speakers.

<Hardware Configuration of the Printing Apparatus>

Figure 2A:
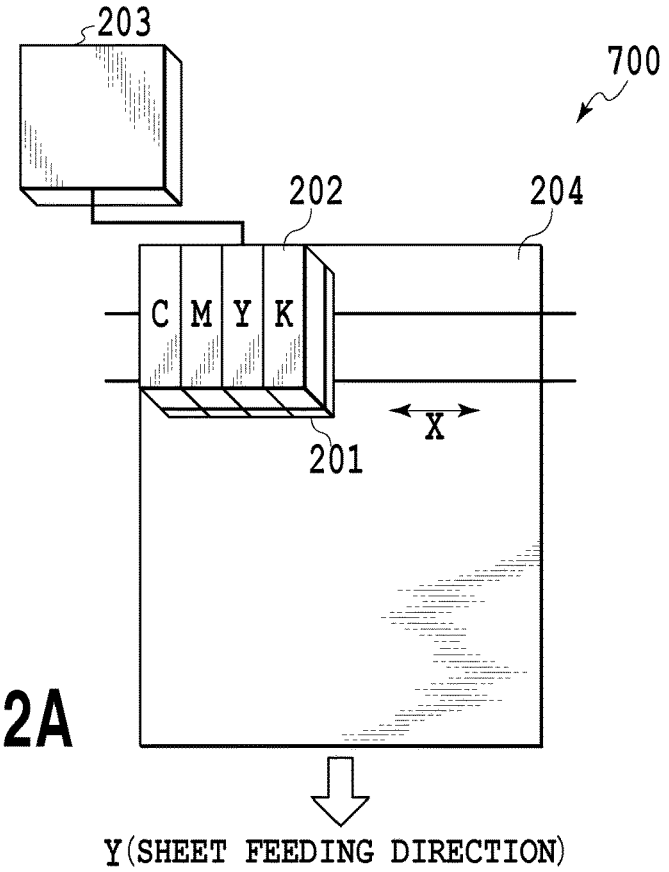
FIG. 2A is a diagram illustrating a basic configuration of a printing apparatus in the present invention.

FIG. 2A is a schematic diagram illustrating a configuration example of the printing apparatus 700. The printing apparatus 700 in the present example is what is called a serial scan system in which a print head 201 and an ink portion 202 filled with ink are mounted in a carriage that moves in a main scanning direction of arrow X. The ink portion 202 in the present example is filled with a cyan (C) ink, a magenta (M) ink, a yellow (Y) ink, and a black (K) ink, and the print head 201 ejects these inks. The number of ink colors is not limited to four. A control circuit portion 203 includes a storage portion, a calculation portion, and a communication portion needed to drive the print head 201. The print head 201 receives print signals and control signals from the control circuit portion 203 to eject the ink in accordance with the control signals. A print medium 204 is conveyed in a sub-scanning direction of arrow Y by a conveying roller not depicted in the drawings. An image is printed on the print medium 204 by alternately repeating an operation in which the print head 201 ejects the ink while moving in the main scanning direction and an operation of conveying the print medium 204 in the sub-scanning direction.

Figure 2B:
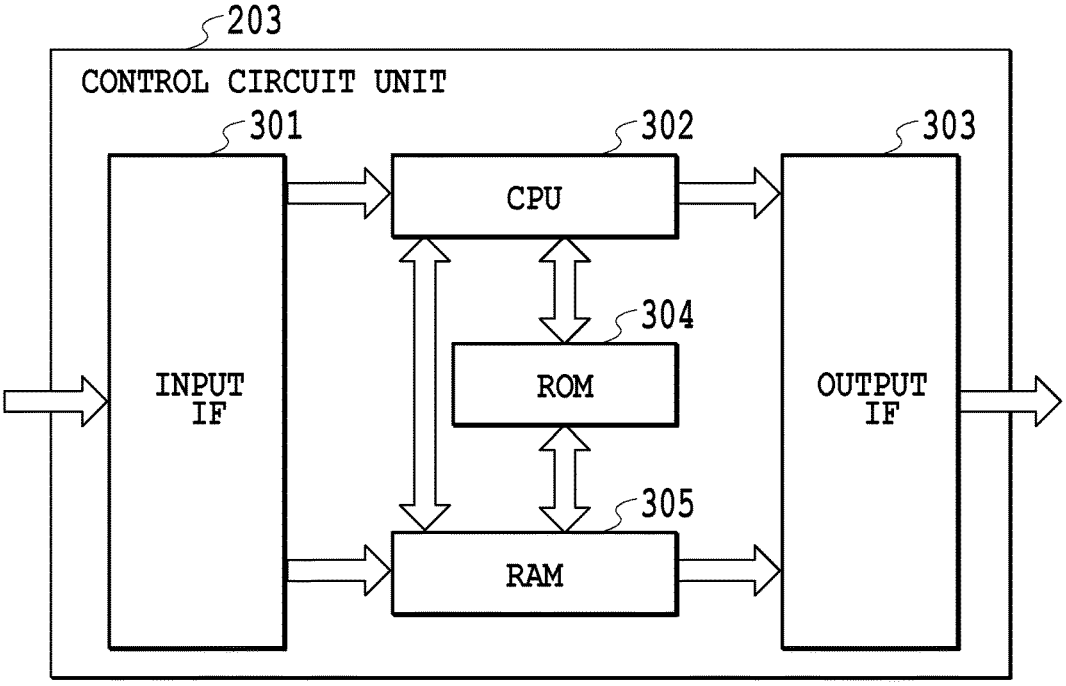
FIG. 2B is a block diagram of a control circuit portion in FIG. 2A.

FIG. 2B is a block diagram illustrating a configuration of the control circuit portion 203. The control circuit portion 203 includes an input interface 301, a CPU 302, an output interface 303, a ROM 304, and a RAM 305. The input interface 301 accepts image data to be printed and a control signal intended to drive the print head 201 from an operation portion not depicted in the drawings, an external computer, or the like. The input interface 301 sends the image data and the control signals to the RAM 305 and the CPU 302. At this time, the CPU 302 executes a control program stored in the ROM 304 to subject the image data to signal processing. The image data subjected to signal processing is output from the output interface 303 along with the control signal as print data. The print head 201 is driven in accordance with the output print data and control signal to print an image on the print medium 204.

FIG. 2A and FIG. 2B depict a part of a hardware configuration of the printing apparatus 700. A method for printing an image while conveying a tray may be a well-known method as described in, for example, Japanese Patent Laid-Open No. 2005-104112. A printing apparatus 700 in Japanese Patent Laid-Open No. 2005-104112 includes a feeding unit (sheet feeding unit) A, a conveying unit (sheet conveying unit) B, a discharge unit (sheet discharge unit) C, a carriage unit D, a recovery mechanism unit E (cleaning unit), a printing unit F (head), and a CD conveying unit G.

(Feeding Unit A)

The feeding unit A includes a pressure plate on which sheet-like print media are stacked, and a feeding roller that feeds the print medium. Printable discs serving as print media are stacked on the pressure plate and fed along with the pressure plate by the feeding roller.

(Conveying Unit B)

The conveying unit B includes the conveying roller and a PE sensor. To apply a load to the rotating conveying roller to stabilize a conveying operation, a tension spring is provided between a bearing and the conveying roller. The tension springs bias the conveying roller to apply a predetermined load to the conveying roller.

(Discharge Unit C)

The discharge unit C includes two discharge rollers, a spur that contacts the discharge rollers at a predetermined pressure to rotate in conjunction with rotation of the discharge rollers, and a gear row configured to transmit a driving force exerted by the conveying roller to the discharge rollers. The discharge rollers are attached to a platen. The upstream discharge roller in a conveying direction includes a metal shaft on which a plurality of rubber portions is provided. The downstream discharge roller in the conveying direction includes a resin shaft to which a plurality of elastic bodies such as elastomers is attached. A spur spring with coil springs provided like bars, for example, allows the spur to be attached to a spur holder and to be brought into pressure contact with the discharge rollers. Examples of the spur include those which chiefly allow exertion of a force allowing a print medium such as a sheet to be conveyed during printing and those which chiefly inhibit the print medium such as a sheet from floating during printing.

A sheet end support is provided between the two discharge rollers. The sheet end support raises opposite ends of a sheet serving as a print medium and holds the sheet at a tip of the discharge rollers. Therefore, degradation of a print image on a previously discharged sheet resulting from rubbing of the print image is suppressed and deterioration of print quality is restrained. In the sheet end support, a resin member is biased by a sheet end support spring to press the rollers against the sheet to raise the opposite ends of the sheet, providing the sheet with resilience. In this state, the sheet is held.

(Carriage Unit D)

The carriage unit D includes a carriage equipped with a print head (ink jet print head) that can eject the ink through ejection ports. The carriage is guided by a guide shaft and a guide rail extending in the main scanning direction crossing the conveying direction for the print medium (in the present example, orthogonal to the conveying direction), so as to be able to reciprocate in the main scanning direction. The guide rail holds the carriage at a rear end thereof to keep the distance (clearance) between the print head and the print medium at an appropriate value. The guide shaft is attached to a chassis of the printing apparatus main body, and the guide rail is formed integrally with the chassis.

(Recovery Mechanism Unit E)

The recovery mechanism unit E includes a suction pump that executes a suction recovery process for maintaining and recovering ink ejection performance of the print head. The recovery mechanism unit E includes a cap configured to protect an ejection port surface of the print head in which ejection ports are formed and to prevent the ejection port surface from being dried. The recovery mechanism unit E further includes a wiper blade configured to wipe away attachments (ink, dust, and the like) to peripheral portions of the ejection ports on the ejection port surface of the print head.

(Printing Unit F)

The printing unit includes the ink jet print head. The print head is provided with replaceable ink tanks for the respective ink colors. The print head ejects the ink through the ejection port using an ejection energy generating element such as electrothermal transducing element (heater) or piezoelectric element. In a case where electrothermal transducing element is used, the electrothermal transducing element is allowed to generate heat to bubble the ink so that the resultant bubbling energy can be utilized to eject the ink through the ejection port. The ink ejected through the ejection port is allowed to land on the print medium to print an image on the print medium.

(CD Conveying Unit G)

The CD conveying unit G includes a slide cover, a tray guide, and an arm. An inclined portion is formed at a tip of the arm. With the CD conveying unit installed in the printing apparatus, the arm is allowed to protrude (advance) toward the main body of the printing apparatus. Then, the arm smoothly slips in between the platen and the spur holder. The insertion of the arm allows formation, between the platen and the spur holder, of a space through which the tray provided with a CD (CD-R or the like) serving as a print medium passes. The arm is inserted and positioned between the platen and the spur holder. Before being allowed to protrude (advance), the arm is housed in the tray guide so as to have a backlash with respect to the tray guide. With a slide cover not moved toward the main body of the printing apparatus, an opening in the CD conveying unit is closed, precluding insertion of the tray. In a case where the slide cover is moved toward the main body of the printing apparatus, the slide cover moves obliquely upward to form, between the slide cover and the tray guide, the opening through which the tray is inserted. Consequently, the tray provided with the CD can be inserted through the opening for tray insertion and set in position.

(Tray)

The tray is formed of, for example, a resin board with a board thickness of approximately 2 to 3 mm. The tray is provided with a CD attachment portion, an operation portion that is gripped by the user to load and unload the tray, position detection marks, a CD unloading hole, a tray insertion alignment mark, a side pressure roller recessed portion, and a medium presence sensing mark. A tray sheet is attached to the tip of the tray to ensure that the tray slips (bites) into the area between the conveying roller and a pinch roller. The tray sheet is formed of a sheet material such as PET which has a thickness of approximately 0.1 to 0.3 mm, and has a predetermined coefficient of friction and a predetermined hardness. A tapered portion is formed at a tip portion of the tray.

The tray sheet bites into the area between the conveying roller and the pinch roller to exert a force allowing the tray sheet to be conveyed. Subsequently, the tapered portion at the tip of the tray raises the pinch roller to sandwich the tray, which is substantially thick, between the conveying roller and the pinch roller, enabling the tray to be accurately conveyed.

Each of the position detection marks is provided at a position corresponding to a position between the adjacent pinch roller pieces. Consequently, the position detection mark is inhibited from contacting the pinch roller, thus preventing a surface of the position detection mark from being damaged. The position detection mark is provided at two positions close to the tip of the tray to which the CD is attached, and one opposite position. The position detection mark includes a member with high reflection performance in a square area of approximately 3 to 10 mm on a side. A recessed portion is formed around the position detection mark. A reflection material may be formed so as to conform to the shape of a position detection mark portion of the resin portion. A bottom portion of the recessed portion around the position detection mark has an excellent surface texture and is formed to have a predetermined angle. Thus, even in a case where light emitted from a tray position sensor provided on the carriage is reflected by any portion other than the position detection marks, the reflected light is prevented from returning to a light receiving portion of the tray position sensor. Therefore, misdetection is prevented during detection of the position of the tray.

In Japanese Patent Laid-Open No. 2005-104112, the CD conveying unit G is configured so as to be attached to the printing apparatus for use. However, the present invention is not limited to this. The CD conveying unit G may be formed to be installed in the printing apparatus 700. The CD conveying unit G is not limited to the configuration in which the print medium is the CD. The print medium printed using the tray is not limited to the CD, but may be any of various print media that can be printed using a tray that can be conveyed. The configuration in which an image is printed on the print medium using the tray is not limited to the configuration described in Japanese Patent Laid-Open No. 2005-104112. Any configuration may be used in which the print medium is fitted into the tray, which is conveyed along with the print medium, on which an image is printed.

<Software Configuration>

Figure 3A:
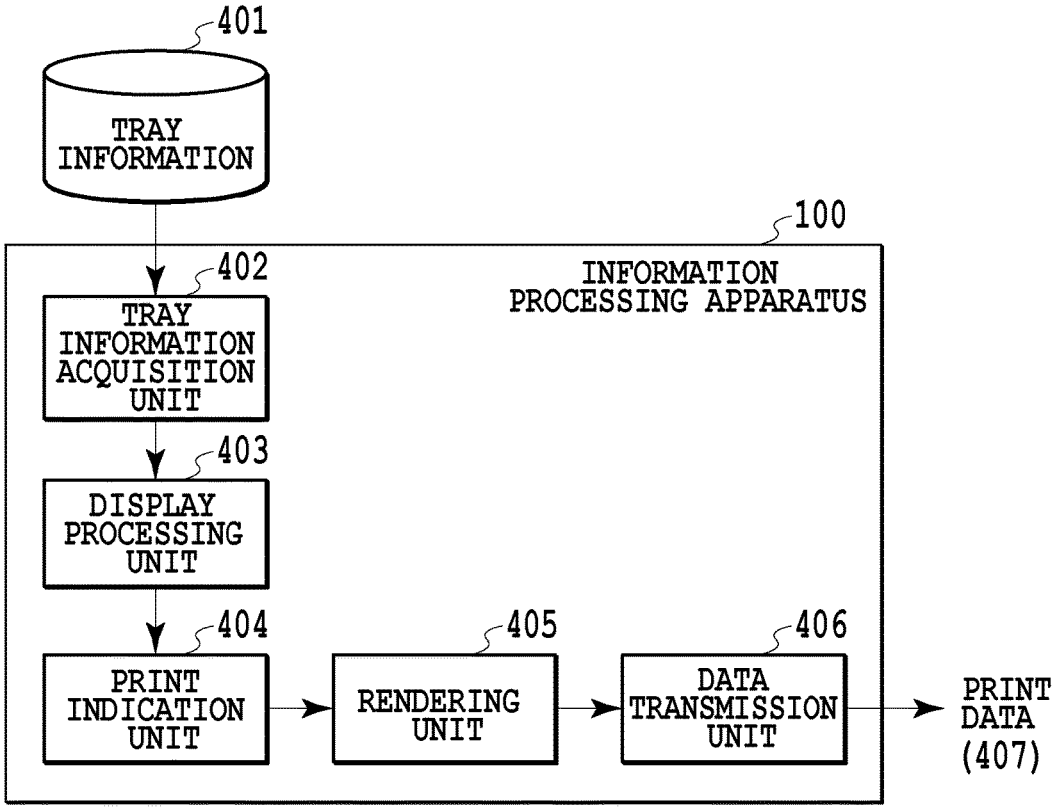
FIG. 3A is a block diagram illustrating a basic configuration of the information processing apparatus.

FIG. 3A is a block diagram illustrating a configuration example of the information processing apparatus 100. The information processing apparatus 100 is, for example, a terminal apparatus that is in the form of a personal computer, a smartphone, a tablet PC, or the like and that involves an image display process and a communication process.

Figure 4A:
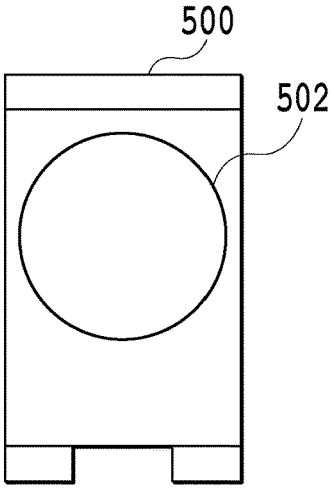
FIG. 4A and FIG. 4B are diagrams of a basic configuration of a tray in the present invention.
Figure 4B:
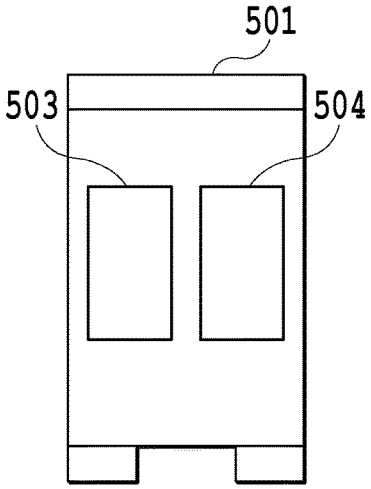

Tray information 401 is information on the tray used in the printing apparatus. The printing apparatus conveys the tray with the print medium fitted therein and prints an image on the print medium. The tray information 401 includes information on the size and shape of the print medium and the position in the tray where the print medium is fitted. The tray information 401 also includes information allowing the tray to be discriminated so that the information processing apparatus 100 can select a tray to be used. FIG. 4A depicts a dedicated tray 500 for disc labels that is used for print medium with a circular print area such as CDs and DVDs and that has an area 502 into which the print medium is fitted. FIG. 4B is a dedicated tray for cards that is used for print medium with a rectangular print area such as cards and business cards and that has areas 503, 504 into which print media are fitted. The types of trays used to print images on print media with different shapes are held in the form of ID numbers and the like as the tray information 401. As the tray information 401, information is also held that relates to the size of a printable area according to the type of the tray, the number of print media that can be fitted into the tray, a print start position, a non-printable area, and the like.

A tray information acquisition unit 402 acquires and holds the tray information 401 in a memory in the information processing apparatus 100. The tray information 401 may be acquired from the exterior of the information processing apparatus 100 or pre-held in the memory in the information processing apparatus 100. The tray information 401 may be information stored in a memory in a server through a communication line. The tray information acquisition unit 402 may pre-set an apparatus from which the tray information 401 is to be acquired. For example, in a case where the tray information is stored in the memory in the information processing apparatus 100, data access to the memory is gained to acquire the tray information 401. Alternatively, in a case where the tray information 401 is stored in a server connected to the information processing apparatus 100 through a communication line, the server is accessed through the communication line. Access to the file holding the tray information 401 is gained to acquire a tray information file, and the tray information 401 is acquired from the tray information file.

In a case where the tray information 401 is stored in a printing apparatus connected to the information processing apparatus 100 through a communication line, the printing apparatus is accessed through the communication line. When the information processing apparatus 100 requests the printing apparatus to provide the tray information 401, the tray information 401 held in the printing apparatus is transmitted to the information processing apparatus 100, which thus acquires the tray information 401.

A display processing unit 403 displays image and character information and the like for a print target. The display processing unit 403 has a display function for a screen with buttons and the like arranged therein to select image and character information and the like for a print target. The display processing unit 403 also has a display function for a screen displaying a print setting list used to set print conditions and the like and having buttons and the like arranged to allow selection of the print condition from the print setting list. The display processing unit 403 also has a display function for the tray information 401 acquired by the tray information acquisition unit 402.

Figure 4C:
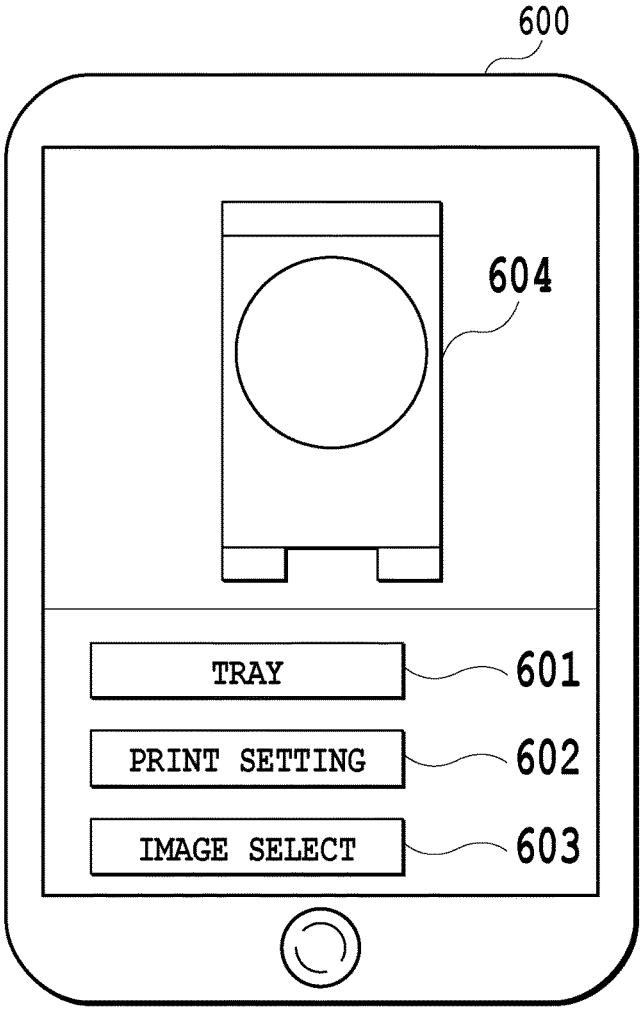
FIG. 4C is a diagram of a specific example of the information processing apparatus.

FIG. 4C depicts a smartphone 600 as an example of the information processing apparatus 100. On a display of the smartphone 600, a tray select button 601, a print setting button 602, and a screen select button 603 are displayed. Selection of the tray select button 601 allows a tray select dialog to be started up to display a plurality of pieces of the tray information acquired. For example, an image of the shape of the tray is displayed. Selection of the print setting button 602 allows a print setting dialog to be started up to display information on the registered printing apparatus. This allows print sheets (print medium) to be selected. Selection of the screen select button 603 allows an image select dialog to be started up to display information on images stored in the smartphone 600, images taken with a camera, and the like. This allows selection of an image to be printed.

Based on a selected tray, set print conditions, and a selected image to be printed, the display processing unit 403 further displays, on a preview screen 604, an image of the tray into which the image to be printed has been fitted. In a case where the image to be printed is selected and fitted into the image of the tray, the image to be printed is moved, scaled, and reshaped as needed before the resultant image is fitted into an image in a print area in the displayed tray information. As described above, the display processing unit 403 displays information on a process of fitting the print medium into the tray for printing.

A print indication unit 404 allows print conditions for the printing apparatus to be indicated from the information processing apparatus 100. For example, the print setting button 602 in FIG. 4C allows a print setting dialog screen to be started up. The print setting dialog screen displays, for example, names of the printing apparatuses connected to the network to allow selection of a printing apparatus to be used. The print setting dialog screen allows specification of print setting information such as the size of the print medium (sheet size), for example, CD, A-4 size, or L size, the number of print medium to be printed, and the type of the print medium (plain paper, gloss paper, dedicated paper for CDs, and the like).

The print setting dialog screen also displays a print button that allows, in a case where selected, a print execution process to be performed on the selected printing apparatus based on the print setting information. In the print execution process, a rendering unit 405 creates print data, and a data transmission unit 406 transmits the print data to the printing apparatus. The print setting information may be pre-held in a mobile terminal such as a smartphone or downloaded from the server or the printing apparatus through the network.

The print indication unit 404 allows information needed to execute printing to be selected from the list displayed by the display processing unit 403 and designated as print setting information. The rendering unit 405 utilizes the print setting information selected via the print indication unit 404 to generate print data based on the tray information 401 and the image and character information selected and displayed via the display processing unit 403. For example, image processing is executed such that one image is arranged in the print area in the tray information 401. The tray information 401 includes information on a print content area indicative of a print area. Information indicative of the print area may be, for example, SVG (Scalable Vector Graphics). SVG is a description method that can be utilized in a web standard language to display graphics.

```
<svg width="width of a print content" height="height of the print
content">
<image xlink:href="designation of an image file"
Width="width of a photograph"
Height="height of the photograph"
x="x coordinate of the photograph"
y=" y coordinate of the photograph" />
</svg>
```

As described above, SVG is a string including a list of drawing commands. The commands are interpreted by an interpreter and displayed on a UI. For printing, the above-described print content typically needs to be converted into high-resolution image (what is called bit map data) according to a request from a print engine in the printing apparatus. This processing corresponds to a rendering process. The rendered high-resolution image data corresponds to print data.

Such a rendering process is not limited to SVG. Any well-known technique may be utilized to acquire an image with images or characters arranged in the content area. For example, screen capturing may be performed by rendering using a well-known technique such as HTML (Hyper Text Markup Language) or CSS (Cascading Style Sheets). The print data may be obtained by converting the high-resolution image data into a JPEG (Joint Photographic Experts Group) format. The print data may be obtained by conversion into a PDF format using a well-known PDF (Portable Document Format) technique.

The data transmission unit 406 is connected to the printing apparatus (print processing apparatus) through a communication circuit to convert the print data into a format that can be received by the printing apparatus and to transmit the print data 407 to the printing apparatus. For example, the information processing apparatus 100 and the printing apparatus are connected together by a well-known wireless Wi-Fi technique. The information processing apparatus 100 transmits the print setting information to the printing apparatus as a print command. The information processing apparatus 100 transmits, for example, a rendered JPEG file to the printing apparatus as print data to be printed according to the print data.

A method for transmitting the print data from the information processing apparatus to the printing apparatus is not limited to the present example. A well-known method may be used. For example, the information processing apparatus 100 and the printing apparatus are connected together through a USB port, and the information processing apparatus 100 converts the print data, via a printer driver, into raster data that can be printed by the printing apparatus. The printable raster data is transmitted to the printing apparatus through the USB port. The printing apparatus converts the received raster data into printable data and prints the resultant data.

Figure 3B:
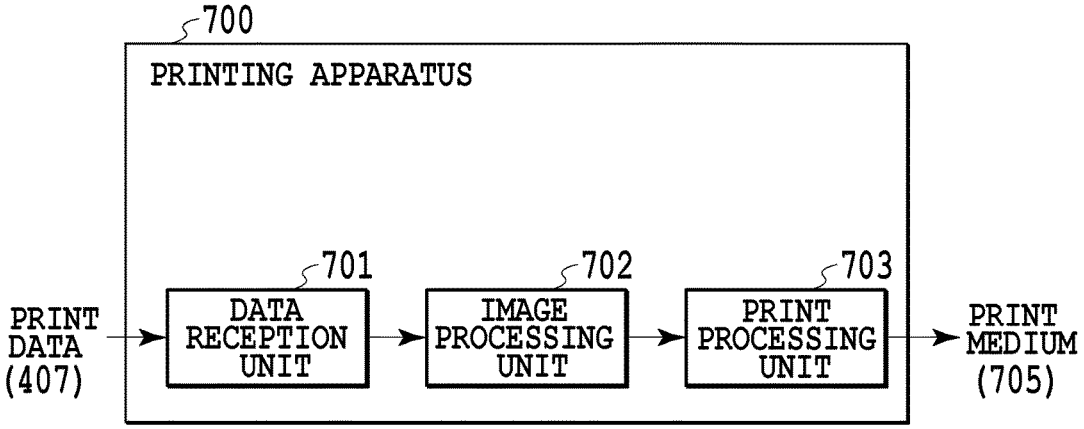
FIG. 3B is a block diagram illustrating the basic configuration of the printing apparatus in the present invention.

FIG. 3B is a block diagram of a software configuration of the printing apparatus (print processing apparatus) 700. The printing apparatus 700 is, for example, an ink jet printing apparatus or a copier and receives the print data and executes a printing process.

A data reception unit 701 receives the print data transmitted by the information processing apparatus 100. For example, the data reception unit 701 receives the print command and the rendered JPEG image. The data reception unit 701 analyzes the received print command and sends the print setting information on the size of the print medium (for example, a sheet size), the type of the print medium, and the like to an image processing unit 702. The data reception unit 701 decodes and converts the received JPEG file into image data and sends the resultant image data to the image processing unit 702.

Based on the print setting information received from the data reception unit 701 and the image data (input image data), the image processing unit 702 executes an image conversion process to generate output image data. For example, in a case where the input image data received from the data reception unit 701 contains 1000 ×1000 pixels and the sheet size and the print resolution in the print setting information are indicative of a DVD size of 120×120 mm and 600 dpi, respectively, the output image data contains 2834×2834 pixels. The image processing unit 702 executes a scaling process on the input image data (1000×1000pixels) received from the data reception unit 701 to obtain the output image data (2834×2834pixels). Examples of a method for the scaling process include the nearest neighbor method, the bilinear method, and the bicubic method. Any of these methods may be selected as needed with the characteristics of the process and a processing speed taken into account.

As described above, the image processing unit 702 converts the input image data into the output image data for printing based on the print setting information. In a case where the print setting information includes correction process information, the image processing unit 702 executes a correction process on the input image data or the output image data. Examples of the correction process for the image include adjustment such as brightness control in which the colors of the entire image are made brighter or darker, contrast control, and color balance, and backlight correction and red eye correction in a photographic printing.

A print processing unit 703 converts the output image data received from the image processing unit 702 into print data. The print processing unit 703 executes a conversion process so as to express the image to be printed by the printing apparatus 700 in suitable colors. A method for conversion into print data may be a well-known color conversion process for converting an image format utilized for image display into ink colors for printing. Any of various methods may be utilized. For example, four color inks in cyan (C), magenta (M), yellow (Y), and black (K) are assumed to be used for the printing apparatus 700. In that case, the print processing unit 703 converts image data in three colors of red (R), green (G), and blue (B) generated by the image processing unit 702 into print data corresponding to four ink colors C, M, Y, K. A color separation table is used for such conversion. The color separation table is used to convert three density values for R, G, B into density values for the ink colors C, M, Y, K. The color separation table is utilized for each of the pixels in the print data to covert the density values for R, G, B into the density values for the ink colors C, M, Y, K.

The print processing unit 703 converts the image data into the print data by output gradation correction using image processing parameters in a lookup table or the like and image processing such as half toning. Based on the resultant print data, the print processing unit 703 ejects the ink to the print medium to print the image.

(First Embodiment)

A first embodiment of the present invention including the above-described basic configuration will be described below. In the present embodiment, based on the above-described basic configuration, printed matter with an image printed thereon is provided. In the present embodiment, an image is printed on a print medium fitted in a tray in a marginless manner. The configuration of the tray used for such marginless printing will be described below.

<Configuration of the Tray>

Figure 5A:
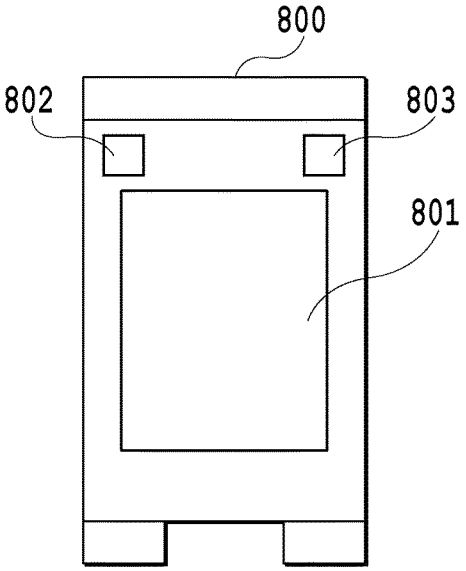
FIG. 5A is a plan view of a tray in a first embodiment of the present invention.
Figure 5B:
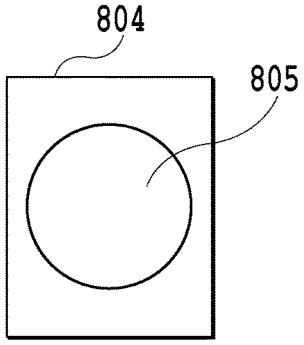
FIG. 5B is a plan view of an adapter tray fitted into the tray.
Figure 5C:
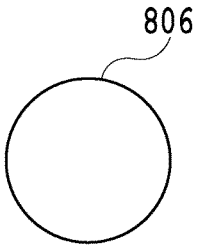
FIG. 5C is a plan view of a print medium fitted into the adapter tray.
Figure 5D:
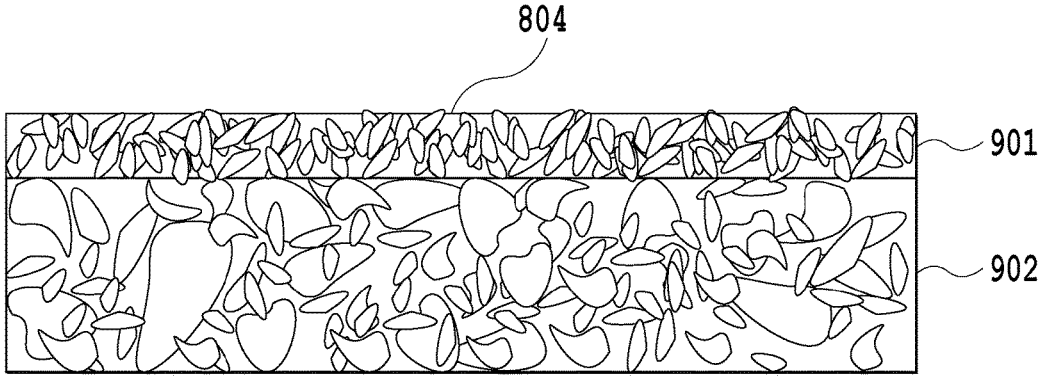
FIG. 5D is a sectional view of the adapter tray.

FIGS. 5A to 5D are diagrams illustrating the tray used for marginless printing executed on a printable disc such as a CD or a DVD as described above. The tray includes a conveying tray 800 and an adapter tray 804. FIG. 5A is a plan view of the conveying tray 800. The conveying tray 800 has a fitting portion 801 into which the adapter tray 804 is fitted in a replaceable manner and reflectors 802, 803 for position adjustment. FIG. 5B is a plan view of the adapter tray 804 fitted into the conveying tray 800, and the adapter tray 804 has a fitting portion 805 into which a print medium 806 such as a CD or a DVD is fitted. The fitting portion 805 forms a holding portion that holds the print medium 806 in a predetermined holding area. FIG. 5C is a plan view of the print medium 806 that is fitted into the fitting portion of the adapter tray 804. FIG. 5D is a sectional view of the adapter tray 804.

The printing apparatus 700 is provided with a tray conveying portion as is the case with the above-described basic configuration. In a case where the conveying tray 800 is inserted into the tray conveying portion, an image can be printed on the print medium 806 on the conveying tray 800. As is the case with the basic configuration, the conveying tray 800 bites into the area between the conveying roller and the pinch roller to exert a force allowing the conveying tray 800 to be conveyed. Thus, the conveying tray 800 needs to be configured to withstand the conveyance and is formed of a hard member, for example, thick plastics.

The adapter tray 804 is formed of a material that can absorb the ink ejected onto the tray outside the print medium 806 for marginless printing. For example, a material for a surface of the adapter tray 804 is ink jet print paper such as coated paper or gloss paper.

The adapter tray 804 in the present example has a layered configuration including a coat layer 901 and a base layer 902 as depicted in FIG. 5D. The coat layer 901 mainly contains a porous-particle-based component and a polymer-based component. An example of the porous-particle-based component is silica gel. An example of the polymer-based component is gelatin.

The coat layer 901 may be a porous-particle-based material for the coated paper. The porous-particle-based material for the coated paper absorbs the ink to allow the ink to infiltrate through gaps between particles. Absorption of the ink by the coat layer 901 allows suppression of swelling of the surface of the adapter tray 804 by the ink. The base layer 902 may be photographic paper formed of pulp extracted from wood or grass or chemical synthetic fiber. The base layer 902 need not necessarily be formed of a material that absorbs the ink. The base layer 902 forms the fitting portion 805 into which the print medium 806 is fitted, and is thus formed of thick paper of a laminate structure in which materials, for example, sheets of paper, are laid on top of one another so as to exhibit a certain intensity, in order to prevent the fitted print medium 806 from being significantly distorted. The adapter tray 804 may have the fitting portion 805 for at least one print medium. The surface layer of the adapter tray 804 in a peripheral area of the fitting portion 805 may be formed of any material that can absorb the ink and is not limited to the material in the present example.

In the present example, an ink absorption portion is formed all over the surface of the adapter tray 804 using the material that can absorb the ink. However, the ink absorption portion may be provided at least at a position adjacent to the holding area (fitting portion) for the print medium. For example, in a case where an image is printed with no margin formed in a part of the peripheral portion of the print medium 806, the ink absorption portion may be provided at a position adjacent to that part. In other words, the ink absorption portion may be provided at a position adjacent to at least a part of the holding area for the print medium 806. In a case where an image is printed with no margin formed along the entire circumferential portion of the peripheral portion of the print medium 806, the ink absorption portion is provided at a position adjacent to the circumferential portion. In other words, the ink absorption portion is provided around the holding area for the print medium 806.

As described above, in the present embodiment, the adapter tray is fitted into the conveying tray, and the area into which the print medium is fitted is formed in the adapter tray. In the adapter tray, at least the periphery of the area into which the print medium is fitted is formed of the material forming the ink absorption layer. Provision of such an adapter tray allows a marginless image to be printed on the print medium on the conveying tray (marginless printing) while suppressing a decrease in conveyance accuracy for the conveying tray (Second Embodiment)

A second embodiment of the present invention including the above-described basic configuration will be described below. In the above-described first embodiment, the adapter tray includes the ink absorption layer. However, in the marginless printing, the ink is ejected to the adapter tray itself. Thus, repeated execution of the marginless printing may preclude the ink absorption layer in the adapter tray from absorbing the ink. In a case where the adapter tray is replaced with a new one each time the marginless printing is performed, the cost of the marginless printing may be raised.

The present embodiment is designed to reduce the cost of the marginless printing, and will be described based on FIG. 6A. Components of the second embodiment similar to the corresponding components of the first embodiment are denoted by the same reference numerals and will not be described below.

Figure 6A:
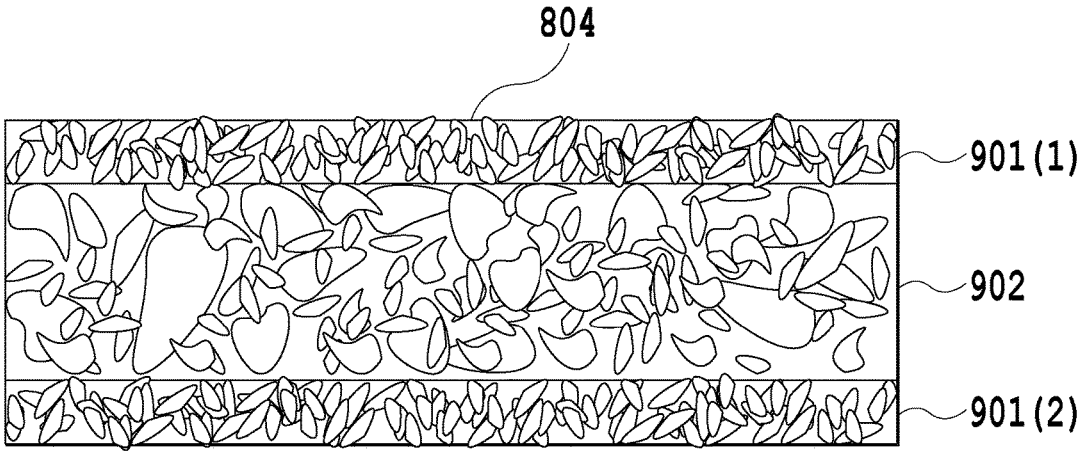
FIG. 6A is a sectional view of a tray in a second embodiment of the present invention.

FIG. 6A is a sectional view of the adapter tray 804 in the present embodiment. The adapter tray 804 includes a coat layer 901 (1), a base layer 902, and a coat layer 901 (2). The adapter tray 804 has the fitting portion 805 that is formed on opposite surfaces of the adapter tray 804 and into which the print medium 806 can be fitted. The fitting portion 805 may be discretely formed on each of the opposite surfaces of the adapter tray 804. Alternatively, the fitting portions into which the print medium 806 can be fitted may be formed on the respective surfaces of the adapter tray so as to include a common part.

In the adapter tray 804 in the present example, a coat layer forming an ink absorption layer is formed on each of opposite surfaces of the base layer 902. The coat layer on one surface of the base layer 902 is referred to as the coat layer 901 (1). The coat layer on the other surface of the base layer 902 is referred to as the coat layer 901 (2). Since the coat layers 901 (1), 901 (2) on the opposite layers of the adapter tray 804 form the ink absorption layer, the ink can be absorbed using the coat layers during the marginless printing. That is, first, the marginless printing is performed such that the ink is absorbed by one of the coat layers. In a case where the coat layer no longer absorbs the ink, the adapter tray 804 is turned over on the conveying tray 800. Consequently, the marginless printing can be performed such that the ink is absorbed by the other coat layer.

In a case where the marginless printing is repeated for a plurality of the print media 806, the adapter tray 804 can be turned over for use. The fitting portions 801, 805 are formed such that the print medium 806 is located at the same position on the conveying tray 800 even in a case where the adapter tray 804 is turned over. Therefore, regardless of whether or not the adapter tray 804 is turned over, the printing apparatus allows an image to be printed at the same position on the print medium 806 in a marginless manner. A plurality of the fitting portions 805 with the same shape or a plurality of different shapes may be provided at least on one surface of the adapter tray 804 to allow images to be printed on a plurality of print media using one adapter tray 804.

(Third Embodiment)

Now, a third embodiment of the present invention including the above-described basic configuration will be described based on FIG. 6B. Components of the third embodiment similar to the corresponding components of the first embodiment are denoted by the same reference numerals and will not be described below.

Figure 6B:
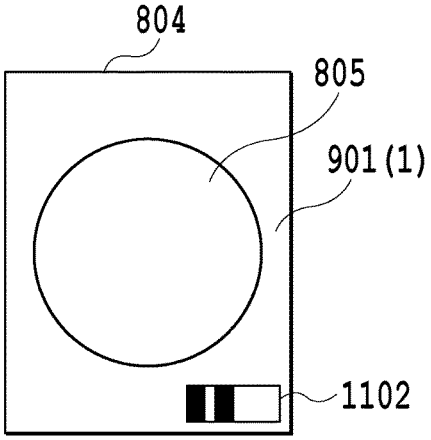
FIG. 6B is a sectional view of a tray in a third embodiment of the present invention.

As depicted in FIG. 6B, on at least one surface of the adapter tray 804 a print count determination area (recording portion) 1102 may be provided in which information on the number of marginless printing operations performed is recorded. In the area 1102, in a case where the marginless printing is performed using the adapter tray 804 information on the number of marginless printing operations performed is recorded. The number of marginless printing operations that can be performed using one adapter tray 804 is preset based on the material of the print medium, the components of the ink, an ink ejection volume, and the like.

For example, the number of marginless printing operations that can be performed using one adapter tray 804 is assumed to beset to four. In this case, the area 1102 includes a to-be-printed area corresponding to four marginless printing operations. Each time one marginless printing operation is performed, a quarter of the to-be-printed area is filled with the ink during the marginless printing operation. In a case where the marginless printing operation is repeated four times, all of the area 1102 is filled with the ink. This allows the user to be notified that, in a case where the fifth marginless printing operation is performed using the same adapter tray 804 the ink may overflow the adapter tray 804. That is, by viewing the area 1102, the user using the adapter tray 804 can determine the number of marginless printing operations performed using the adapter tray 804 and the remaining number of executable marginless printing operations.

In a case where the marginless printing can be performed using the opposite surfaces of the adapter tray 804 as in the case of the second embodiment, the area 1102 can be set on at least one of the opposite surfaces of the adapter tray 804.

(Fourth Embodiment)

In the above third embodiment, the print count determination area (information recording portion) 1102 is filled with the ink according to the number of marginless printing operations performed to allow the user to recognize the number of executable marginless printing operations. However, a method for allowing the user to recognize the number of executable marginless printing operations using the area 1102 is not limited to this.

Figure 6C:
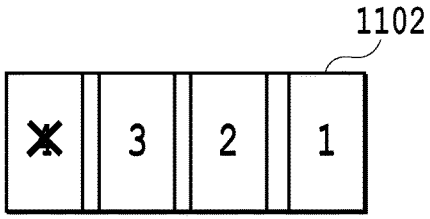
FIG. 6C is a diagram illustrating an information recording portion in a tray in a fourth embodiment of the present invention.

In a fourth embodiment, the number of executable marginless printing operations is numerically pre-described in the print count determination area 1102 as depicted in FIG. 6C. For example, in a case where the remaining number of executable marginless printing operations using one adapter tray 804 is four, numerical values 4, 3, 2, 1 are pre-described in the area 1102. Each time the marginless printing operation is performed, a cross (x) is recorded on one numerical value in the order of 4, 3, 2, 1. By checking numerical values on which no cross is recorded, the user can recognize the remaining number of executable marginless printing operations.

In the third and fourth embodiments, each time the marginless printing operation is performed, the recording position in the area 1102 is changed. Thus, for example, before printing in the area 1102, an optical sensor is used to read the image in the area 1102 of the adapter tray 804 and the read image is analyzed to determine the already printed area indicated in the area 1102. Then, based on the result of the determination, in a case where the marginless printing operation is performed, the print area indicated in the area 1102 other than the already printed area can be printed in the preset order.

In a case where the print information in the area 1102 read using the optical sensor indicates that the number of marginless printing operations performed has already reached the maximum value, the user can determine that, in a case where a further marginless printing operation is performed, the adapter tray may fail to absorb the ink. In such a situation, the printing apparatus 700 may display the situation in the form of a message. Consequently, various methods may be adopted to allow the user to recognize the number of executable marginless printing operations utilizing the area 1102.

As described above, the adapter tray in the present embodiment has the print count determination area indicative of the number of executable marginless printing operations. This allows the user to recognize the number of executable marginless printing operations. For example, the information processing portion provided in the printing apparatus calculates the remaining number of executable marginless printing operations by subtracting the number of marginless printing operations performed using one tray from the number of marginless printing operations that can be performed using the tray. The CPU 102 allows the display portion provided in the printing apparatus to display at least one of the remaining number of executable marginless printing operations and the information recorded in the area 1102.

(Other Embodiments)

The present invention is not only applicable to serial-scan ink jet printing apparatuses but also widely applicable to printing apparatuses based on various printing systems that enable marginless printing with ink. In short, any printing apparatus may be used so long as the apparatus enables marginless printing by application of ink. For example, a full-line printing apparatus may be used.

The above-described embodiments are only examples for producing the effects the present invention. Other similar techniques and different parameters are included within the scope of the present invention in a case where effects similar to those of the present invention are produced using the techniques or the parameters. The present invention is also applicable to a system including a plurality of pieces of equipment (for example, a host computer, an interface equipment, a reader (reading apparatus), and a printer (printing apparatus)). The present invention is also applicable to an apparatus that is one piece of equipment (for example, a printer (printing apparatus), a copier, or a facsimile machine).

The object of the present invention can be accomplished by the following configuration. That is, a storage medium (or a recording medium) is prepared in which software program codes that implement the functions of the above-described embodiments are recorded. The storage medium is supplied to a system or an apparatus. Then, the computer (or a CPU or an MPU) in the system or the apparatus reads and executes the program codes stored in the storage medium. In this case, the program codes read from the storage medium implement the functions of the above-described embodiments. The storage medium storing the program codes forms the present invention. The functions of the above-described embodiments may be implemented by any method other than execution of the read program codes by the computer. For example, an operating system (OS) that operates on the computer may execute a part or all of the actual processing based on the indication of the program codes so that the processing allows the functions of the above-described embodiments to be implemented. Such a configuration is also included in the present invention.

The object of the present invention can be accomplished by the following configuration. That is, the program codes read from the storage medium are written to a memory provided in an expansion card inserted into the computer or in an expansion component connected to the computer. Subsequently, based on instructions in the program codes, for example, a CPU provided in the expansion card or the expansion component executes a part or all of the actual processing so that the processing allows the functions of the above-described embodiments to be implemented. Such a configuration is also included in the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A tray conveyed in a printing apparatus while holding a print medium being printed by a print unit of the printing apparatus, the tray comprising:

a body; and a fitting portion which is provided on the body and into which an adaptor tray is fitted in a replaceable manner, the adapter tray including a holding portion at which a print medium is held inside of the adapter tray and an ink absorption portion for absorbing ink at a position corresponding to the periphery of the print medium.

2. The tray according to claim 1, wherein, in the holding portion, a fitting portion is provided in which the print medium is enabled to be fitted.

3. The tray according to claim 1, wherein the absorption portion is positioned around the holding portion.

4. The tray according to claim 1, wherein the holding portion includes a first holding portion positioned at one surface of the adapter tray and configured to hold the print medium and a second holding portion positioned at the other surface of the adapter tray and configured to hold the print medium, and the absorption portion is positioned adjacent to at least one of the first holding portion and the second holding portion.

5. The tray according to claim 1, wherein the print medium is printed in a marginless manner with ink applied by the print unit, and the adapter tray includes an information recording portion on which information on a number of marginless printing operations performed is recorded.

6. The tray according to claim 5, wherein, in the information recording portion, the information is enabled to be recorded by the marginless printing.

7. The tray according to claim 5, wherein information on a number of the marginless printing operations enabled to be performed using one tray is recorded on the information recording portion and information on a number of the marginless printing operations already performed using the one tray is recorded.

8. The tray according to claim 7, wherein the information recording portion includes a to-be-printed area with a size corresponding to the number of the marginless printing operations enabled to be performed, and the to-be-printed area includes an area on which the number of the marginless printing operations performed is recorded each time the marginless printing operation is performed.

9. The tray according to claim 1, wherein the body is formed of a plastic.

10. The tray according to claim 1, wherein the body is sandwiched by conveying rollers of the printing apparatus.

11. The tray according to claim 1, wherein the holding portion is a fitting portion into which the print medium is fitted in a replaceable manner.

12. The tray according to claim 1, further comprising the adaptor tray.

13. A tray conveyed in a printing apparatus while holding a print medium being printed by a print unit of the printing apparatus, the print medium being held at a holding portion of an adapter tray, the tray comprising:

a body; and a fitting portion which is provided on the body and into which the adaptor tray is fitted in a replaceable manner, the adaptor tray further including an ink absorption portion for absorbing ink at a position corresponding to the periphery of the print medium.

14. A printing apparatus comprising:

a print unit configured to print on a print medium;

a tray including a body and a fitting portion which is provided on the body and into which an adaptor tray is fitted in a replaceable manner, the adapter tray including a holding portion at which the print medium is held inside of the adapter tray and an ink absorption portion for absorbing ink at a position corresponding to the periphery of the print medium; and a conveyance unit configured to convey the tray.

* * * * *